US005489025A

United States Patent [19]

Romick

[11] Patent Number: 5,489,025

[45] Date of Patent: Feb. 6, 1996

[54] UNIT-DOSE MEDICATION DISPENSER AND MULTIPLE-DISPENSER FRAME THEREFOR

[76] Inventor: Jerome M. Romick, Artromick International, Inc., 4800 Hilton Corp. Dr., Columbus, Ohio 43232

[21] Appl. No.: 203,554

[22] Filed: Mar. 1, 1994

[51] Int. Cl.[6] ..... B65D 85/58

[52] U.S. Cl. ..... 206/531; 206/534; 206/539

[58] Field of Search ..... 206/528–540, 206/461–465, 467–471

[56] References Cited

U.S. PATENT DOCUMENTS

| | | | |
|---|---|---|---|
| 3,393,794 | 7/1968 | Borin | 206/539 |
| 3,504,788 | 4/1970 | Gray | 206/531 |
| 4,905,866 | 3/1990 | Bartell et al. | 206/531 |
| 4,998,623 | 3/1991 | Doull | 206/532 |
| 5,019,125 | 5/1991 | Rebne et al. | 206/531 |
| 5,109,984 | 5/1992 | Romick | 206/532 |
| 5,251,757 | 10/1993 | Relyea et al. | 206/531 |

*Primary Examiner*—Jimmy G. Foster

[57] ABSTRACT

A medication dispenser for dispensing unit doses of medication from blister comprises a top plate having a face area and a back area with at least one aperture for receiving a blister of a blister pack, a bottom plate adapted to engage the back area of the top plate to confine the blister pack between the top plate and the bottom plate and having at least one dispensing aperture in register with the blister of the blister pack, a bridge spanning at least a portion of the face area of the top plate which carries a label-receiving surface having an area less than the area of the top plate, and supported above the face area of the top plate by support members a distance great enough to avoid interference with the blisters of the blister pack. One or more of the medication dispensers can be held in a frame which confines the dispensers between side walls having bosses which cooperate with retaining tabs on the medication dispensers to retain the dispensers within the frame.

10 Claims, 6 Drawing Sheets

UNIT-DOSE MEDICATION DISPENSER AND MULTIPLE-DISPENSER FRAME THEREFOR

BACKGROUND OF THE INVENTION

1. Field of the invention

This invention relates to unit-dose medication dispensers and more particularly to reusable medication dispensers that can contain a blister pack of unit doses.

2. Brief description of the prior art

Administration of prescribed medication in correct dosage and at the prescribed times is a serious responsibility of medical professionals entrusted with the care of patients. Particularly in an institutional setting, such as a hospital or nursing home, where medications have to be administered to many patients several times a day over a period of days, weeks, months, or even years, the organization and control of medication dispensing is an important and time-consuming element of patient care.

In order to assist the caregiver and decrease the likelihood of errors in administration of medication, it has become conventional to prepackage the individual unit doses of a course of medication, e.g., tablets, capsules and the like (hereinafter referred to generally as "pills"), in multi-chambered boxes wherein the individual compartments can be separately opened in succession for administration at the appropriate times. To further simplify the process, a course of unit doses is often prepared in a central pharmacy in blister packs. Such packs are prepared from arrays of blisters thermoformed on a thin plastic sheet substrate. Individual unit doses are placed in each blister and sealed therein by laminating a foil or paper layer to the substrate sheet to cover and seal the bottoms of the blisters. The blisters are easily deformable to expel a unit dose through the frangible seal into a container such as a medicine cup.

However, in order to assure that each patient receives the proper medication, the blister pack must be marked with appropriate information, e.g., patient's name, drug name, dose, frequency and/or time of administration and the like. Furthermore, the blister packs are somewhat fragile and can be damaged by the handling to which they are necessarily subjected over the course of the medication, e.g., over a period of a week. In order to protect the blister pack and mark it with the relevant dispensing information various reusable containers have been developed which can accept a blister pack together with a label containing dispensing information.

Inasmuch as a patient may be receiving more than one medication at a time it is also important to provide a system for organizing the several different unit doses according to time of administration. To this end various boxes, drawers and the like have been used to hold and organize the medication dispensers for each drug being administered. Certain medication organizing systems have also been marketed wherein medication dispensers holding a course of a particular drug are fitted into a frame which can hold the medication dispensers for all drugs being administered at one time. Such frames also permit incorporation of several one-week medication dispensers in order to set up a course of medication of several weeks duration.

A medication dispenser using blister packs is disclosed in the inventor's prior patent U.S. Pat. No. 5,109,984. That medication dispenser comprises a blister pack receiving frame having apertures through which the blisters of the blister pack protrude, a bottom plate that supports the blister pack and confines it in contact with the receiving frame, and a hinged cover which covers the blister pack when in closed position and provides a location for a label containing patient and medication information. The medication dispenser of U.S. Pat. No. 5,109,984, however, because it entirely encloses the blister pack, does not permit the supply of unit doses to be checked without opening the dispenser. This dispenser is not adapted to be fitted into a frame for holding multiple dispensers to provide for convenient administration of a number of drugs at the same time.

Another medication dispenser adapted for use with blister packs is illustrated in FIGS. 8 and 9. In this prior art dispenser, the blister pack is confined between a receiving frame 502 and a bottom plate 504, with the blisters 508 protruding through apertures 510 in the receiving frame. The receiving frame 502 and bottom plate 504 are connected by a hinge 506. The bottom plate 504 is provided with dispensing apertures 512 through which the unit dose is expelled from the blister. Instead of a cover, this dispenser is provided with longitudinal walls 514 on the receiving frame 502 and a transverse wall 516 on the bottom plate to give the dispenser its necessary rigidity. The patient and drug information is supplied on a label 518 affixed to the exterior surface of one of the walls, e.g., the transverse wall as shown. In this medication dispenser the upper surface of the blister pack is open to view and the medication supply can be readily checked. However, the patient information label can only be conveniently checked by viewing from a different angle. This dispenser also has no special adaptation for holding a number of the dispensers in a medication organizing frame.

Other medication dispensing systems for containing blister packs have been developed in which a week's supply of medication, contained in a linear blister pack, is inserted into an elongated, narrow box having top and bottom apertures in register with the seven blisters. The box is extended beyond the seven daily apertures to provide a top surface for affixing a label with patient identification and dispensing information. This section of the box also accommodates the conventional eighth unit dose provided as a spare in the blister pack. A number of the elongated boxes are inserted lengthwise into channels in a flat, box-like frame having apertures in its top and bottom designed to register with the apertures in the elongated boxes. Evidently, a construction which either increases the area occupied by the medication dispenser or conceals even a spare unit dose blister represents a design compromise. Furthermore, in such a design wherein the long medication dispensing boxes have to slide along the bottom of the frame, the torn flaps produced when the blister seals are broken can protrude through the bottom apertures and interfere with the smooth removal of the long boxes from the frame.

Accordingly, a need has continued to exist for a medication dispenser and associated organization system that will provide convenient loading of blister packs, permit easy inspection of the contents of the blister packs and convenient display of patient information, and be easily organized into frames that hold a plurality of such medication dispensers.

SUMMARY OF THE INVENTION

This problem has now been solved by the medication dispenser of this invention which contains a blister pack of unit doses comprising a top plate having a face area and back area with at least one aperture for receiving the blister portion of a blister pack, a bottom plate adapted to receive the blister pack and to engage the back area of the top plate so as to confine the blister pack between the top plate and the bottom plate, the bottom plate having at least one dispensing aperture in register with the blister of the blister pack, a bridge spanning at least a portion of the face area of the top plate, the bridge member comprising, a label-receiving surface having an area less than the area of the top plate, and support members extending between the label receiving surface and the face of the top plate, the label-receiving surface being spaced above the face of the top plate a distance sufficient to avoid interference with the blisters of the blister pack.

Accordingly, it is an object of the invention to provide a medication dispenser for containing blister packs of unit doses of medication.

A further object is to provide a medication dispenser for use with blister packs of unit doses which has patient information located within the area occupied by the dispenser.

A further object is to provide a medication dispenser for use with blister packs of unit doses in which the contents of the blister pack can be easily inspected.

A further object is to provide a medication dispenser for use with blister packs of unit doses which is adapted for incorporation in a multiple-dispenser frame.

A further object is to provide a frame for holding a plurality of medication dispensers.

Other objects of the invention will become apparent from the description of the invention which follows.

DETAILED DESCRIPTION OF THE INVENTION AND PREFERRED EMBODIMENTS

Figure 1:
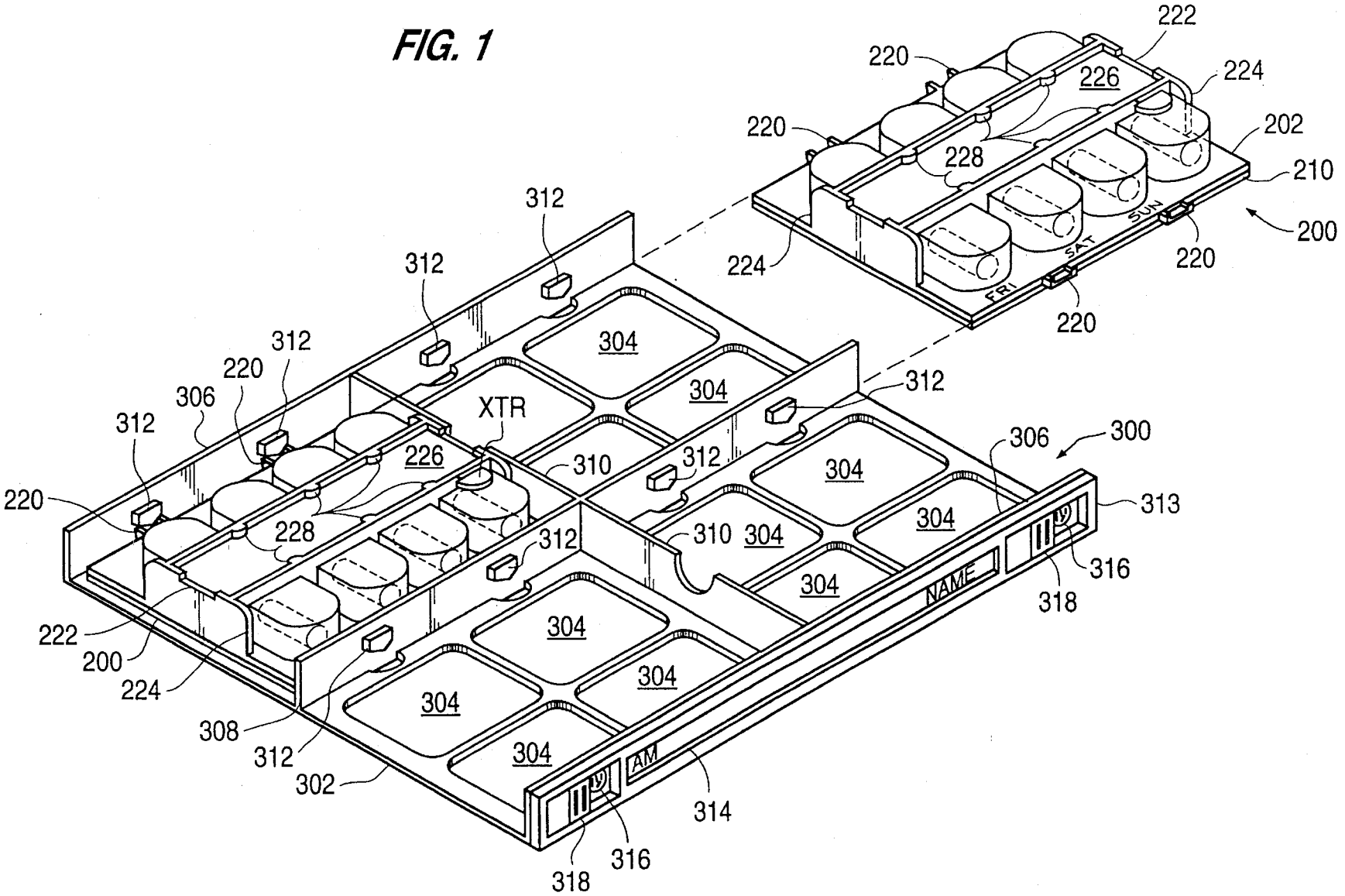
FIG. 1 is an overview of the medication dispenser of this invention showing its installation in the multi-dispenser frame of the invention.

In the detailed description of the invention which follows reference is made to the illustrations of the medication dispenser holder and the multiple-card frame in FIGS. 1–7, wherein the parts of the devices are designated by reference numerals which are the same throughout the figures.

Figure 2:
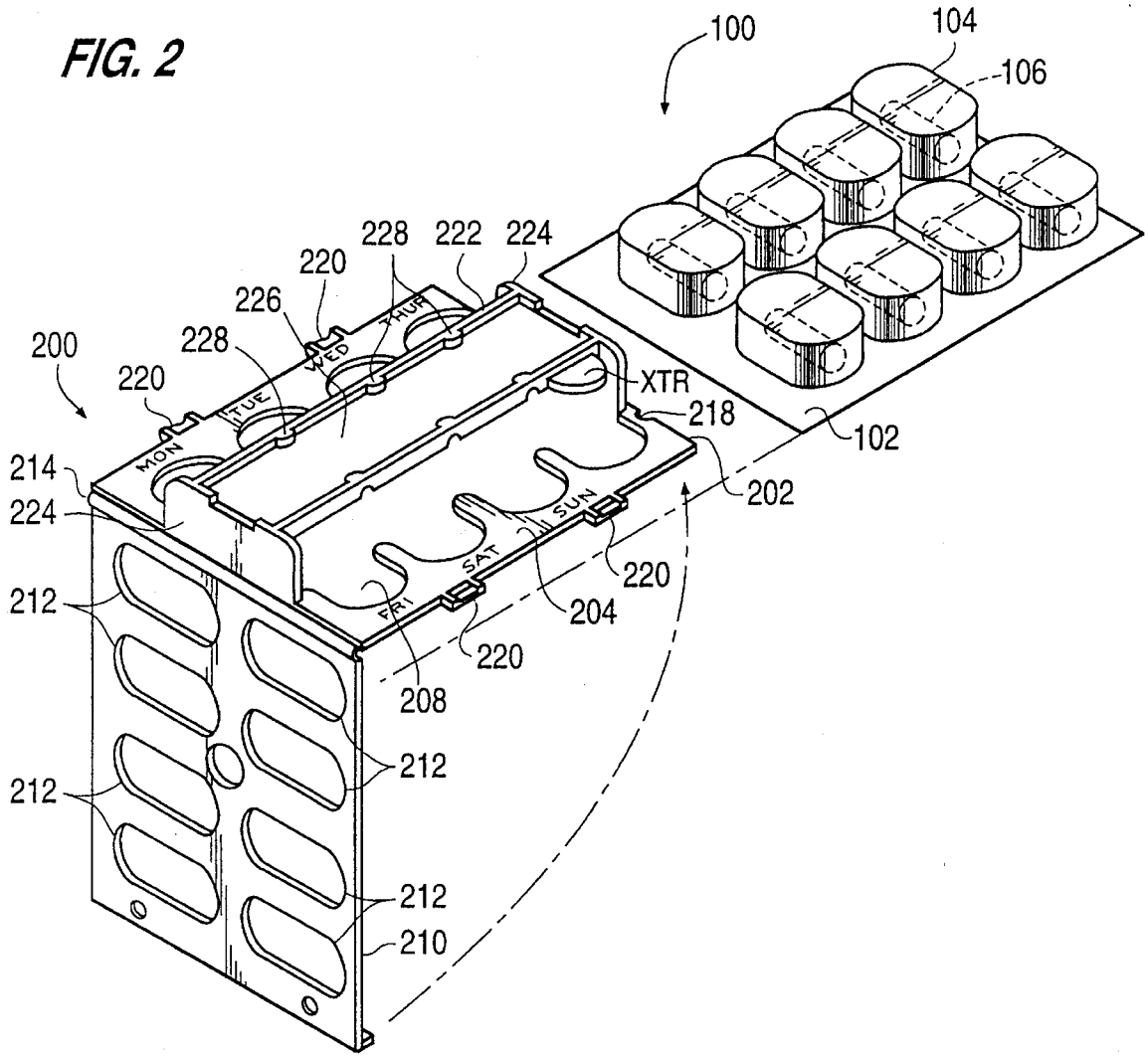
FIG. 2 is an isometric view of the medication dispenser of the invention showing the insertion of a blister pack.
Figure 3:
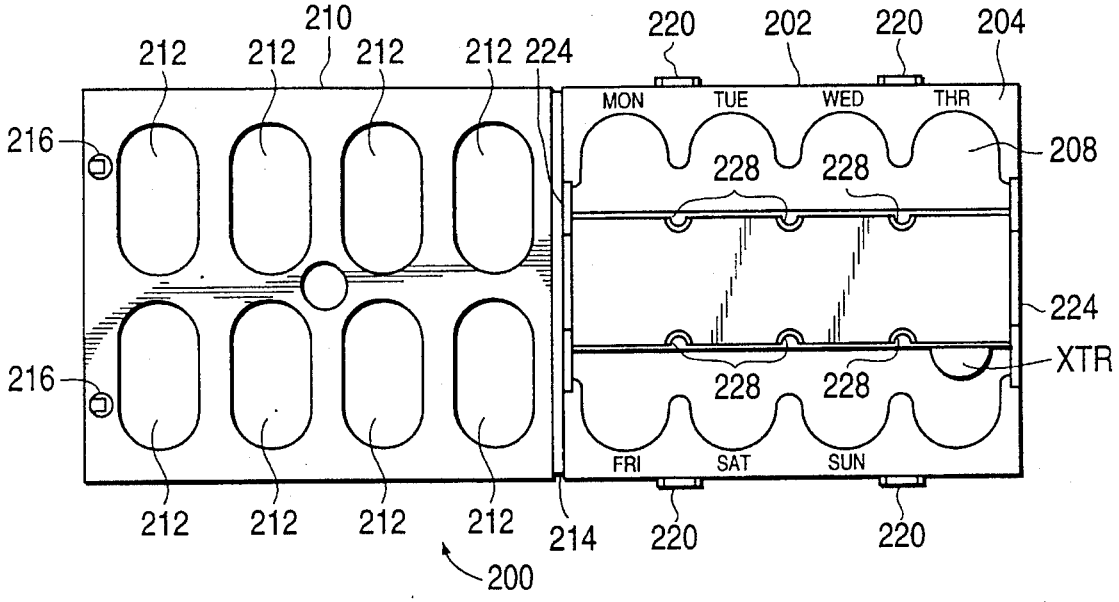
FIG. 3 is a top view of the medication dispenser in unfolded condition.
Figure 4:
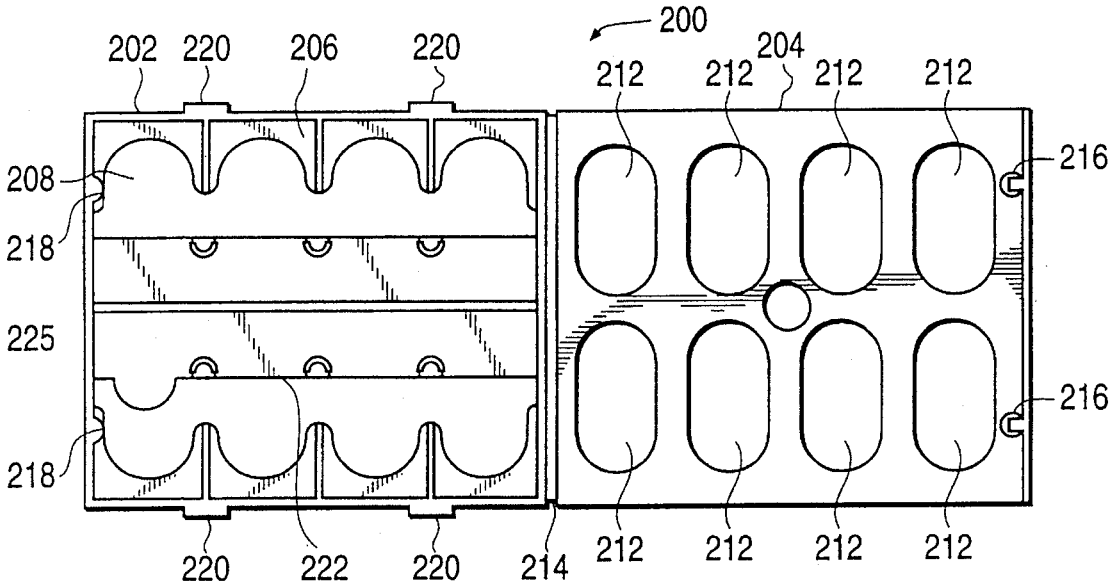
FIG. 4 is a bottom view of the medication dispenser in unfolded condition.
Figure 5:
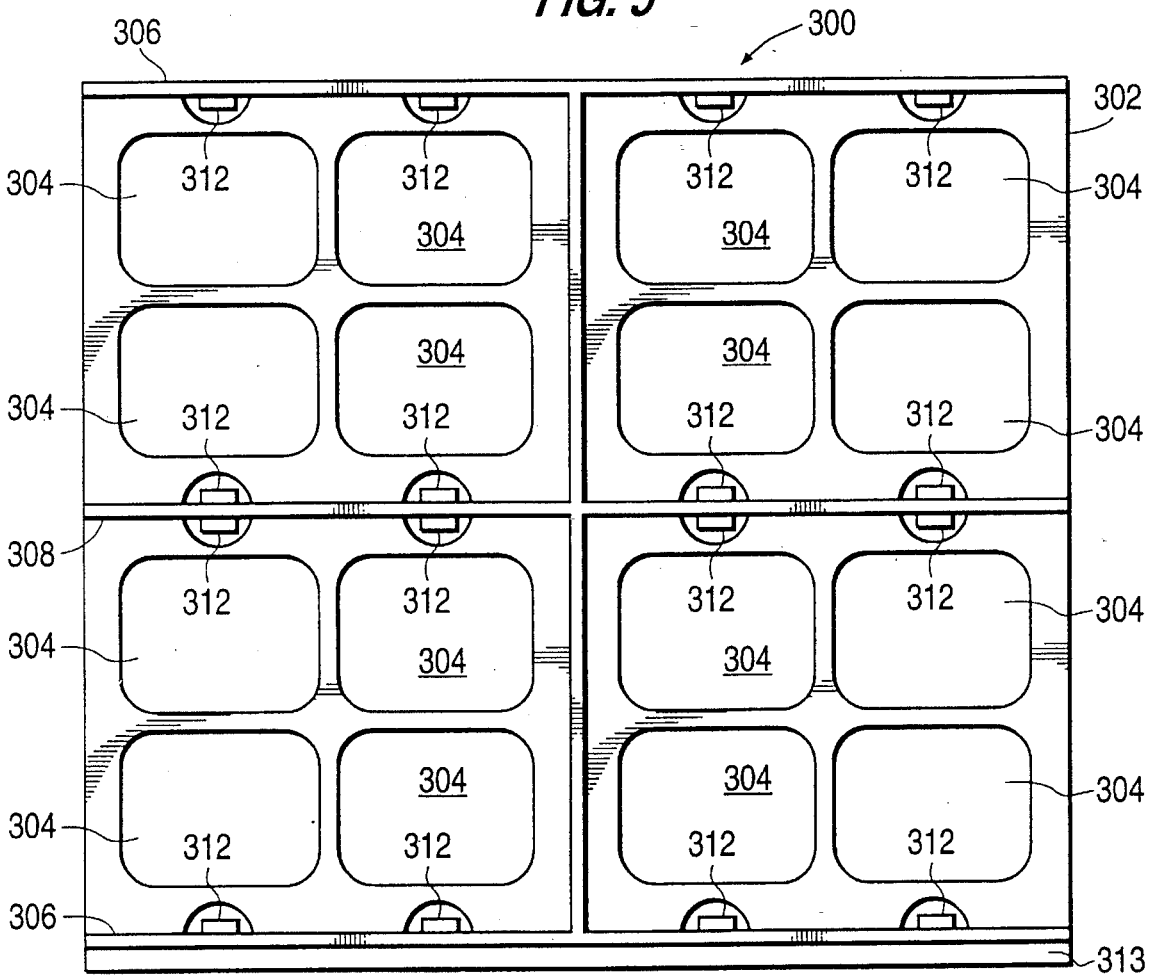
FIG. 5 is a top plan view of the multiple-dispenser frame of the invention.
Figure 6:
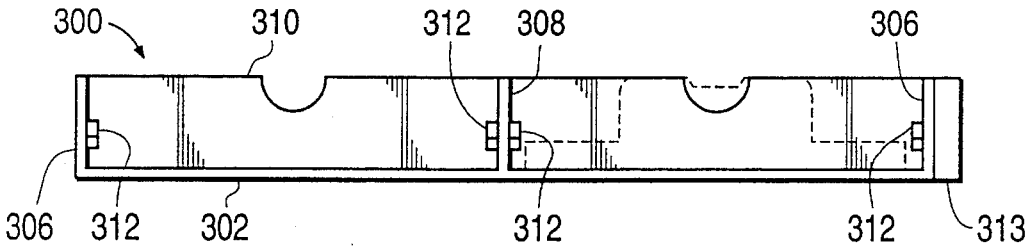
FIG. 6 is an end elevation view of the multiple-dispenser frame of the invention.
Figure 7:
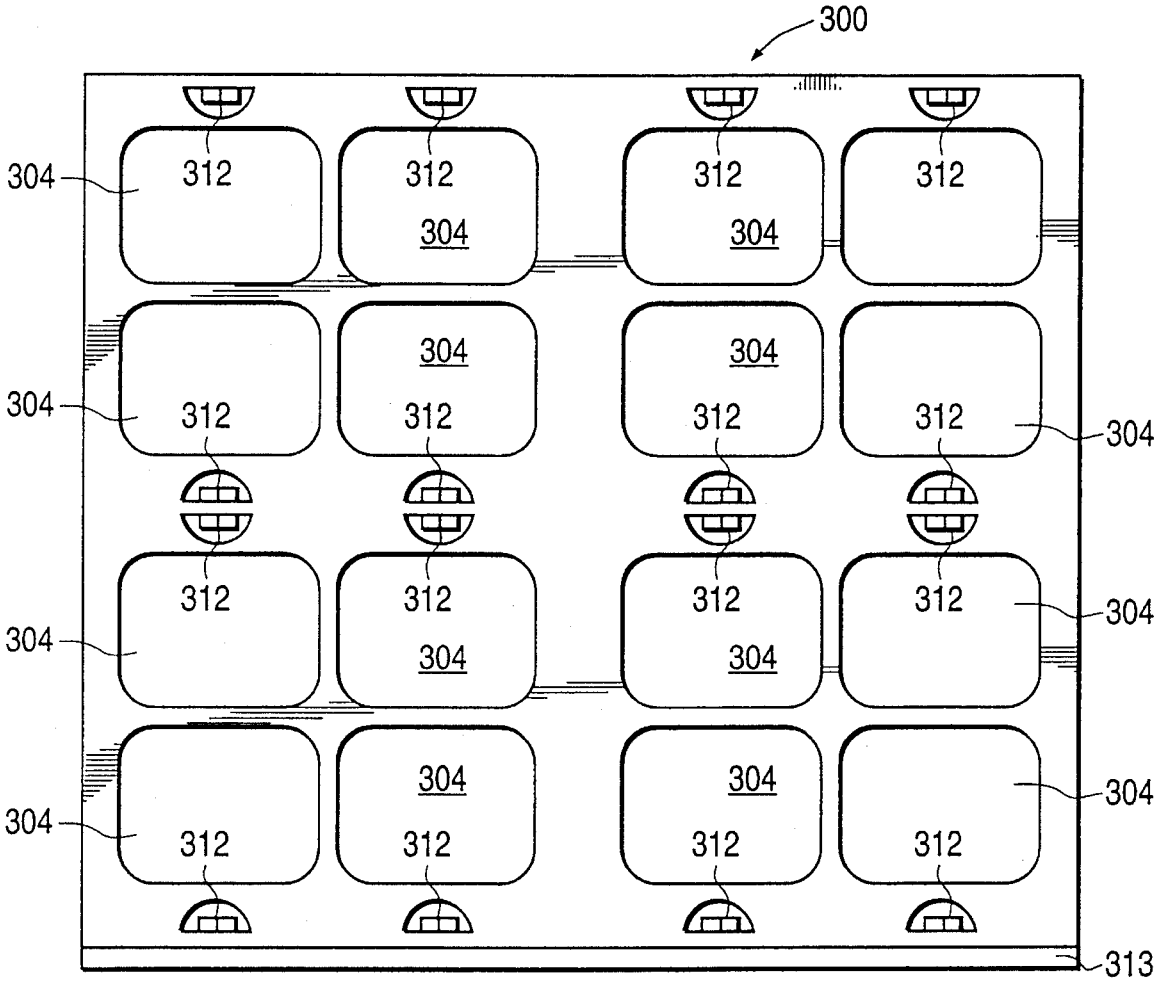
FIG. 7 is a bottom view of the multiple-dispenser frame of the invention.
Figure 8:
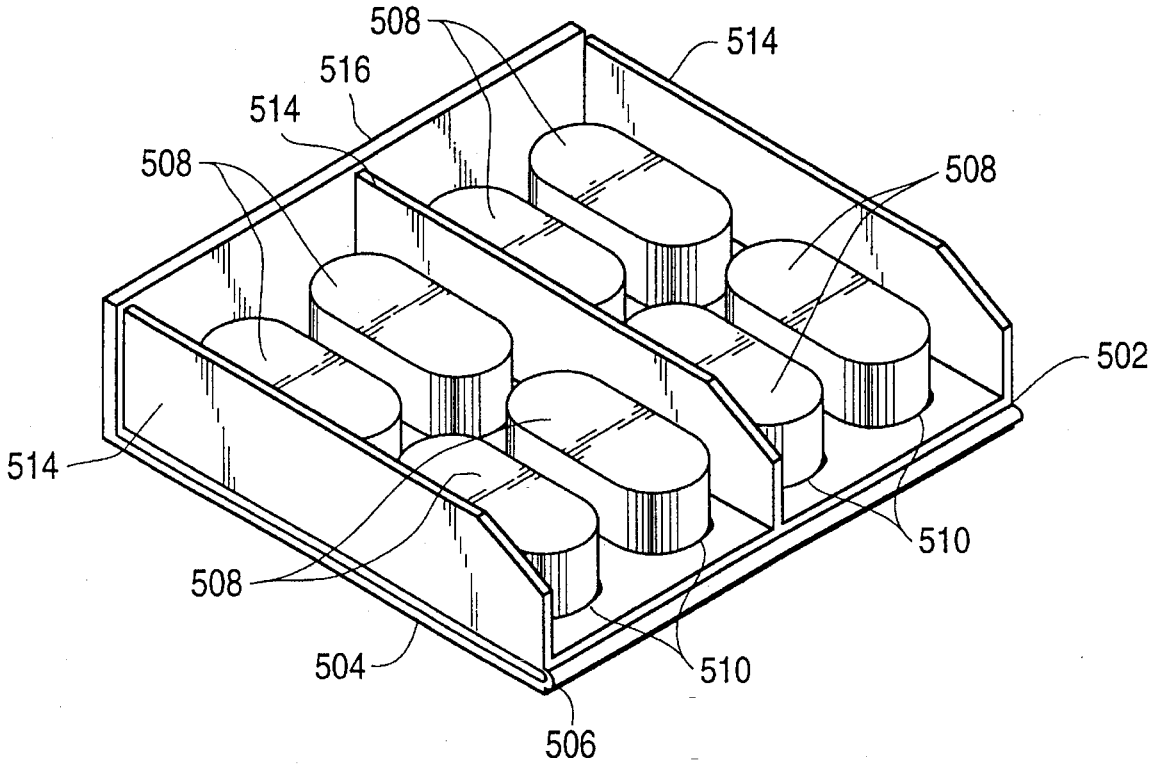
FIG. 8 PRIOR ART
FIG. 8 is an isometric view of a medication dispenser of the prior art for holding a blister pack.
Figure 9:
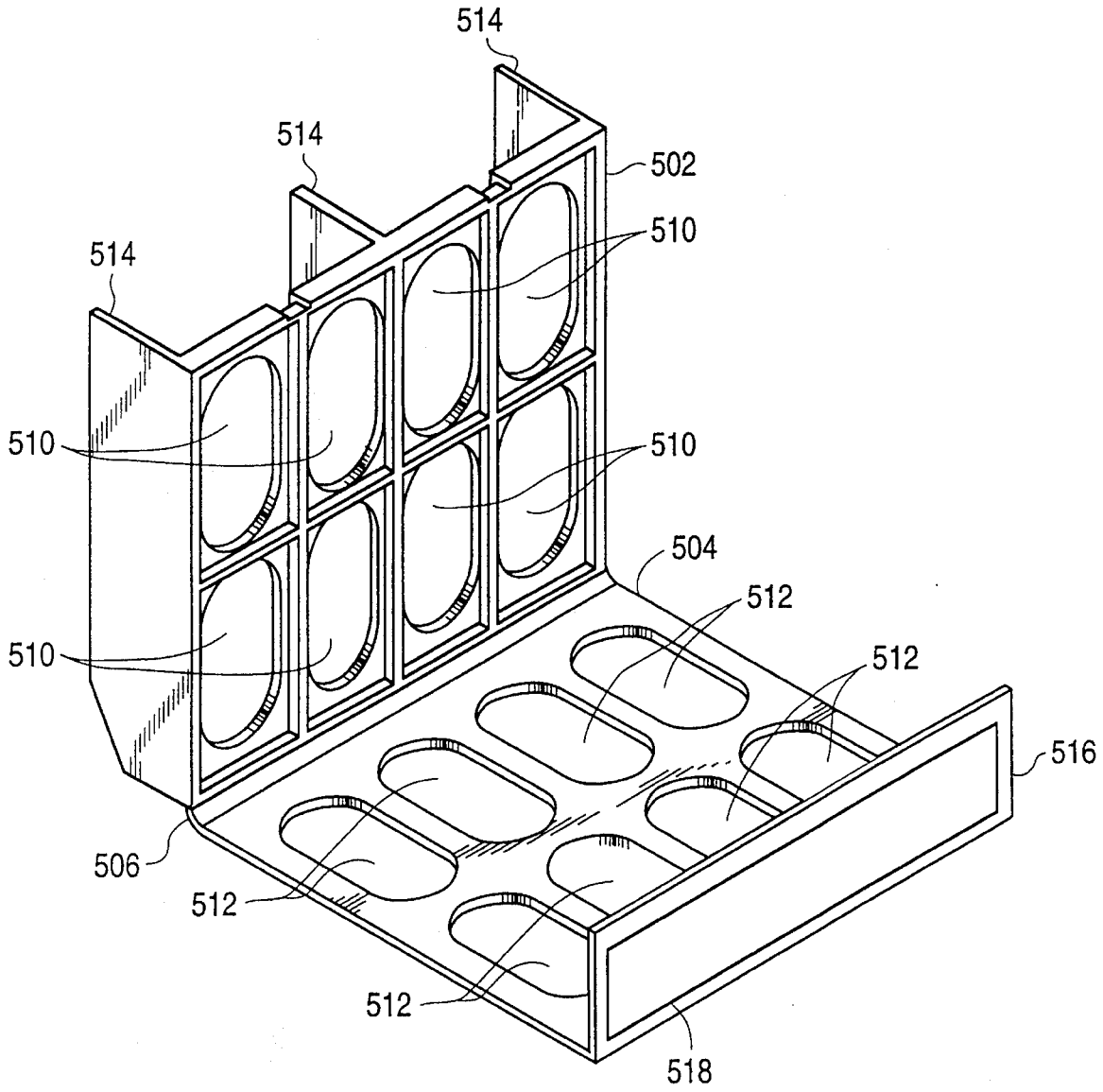
FIG. 9 PRIOR ART
FIG. 9 is an isometric view of the prior art medication dispenser of FIG. 8 partially unfolded.

The details of the medication-dispensing blister pack holder of this invention are illustrated in FIGS. 2, 3 and 4.

The medication-dispensing blister pack holder 200 is designed to hold a blister pack 100 comprising a plastic base sheet 102 having blisters 104 formed on the sheet, e.g., by a thermoforming process, and extending upward therefrom. Each blister 104 holds a unit dose pill 106. The bottom openings of the blisters 104 are sealed, as is conventional, by a foil or paper sheet, not shown, laminated to the lower surface of the base sheet 102.

The holder of the invention 200 comprises a top plate 202 having a face area 204 and a back area 206. The top plate 202 contains at least one aperture 208 through which a blister 104 of a blister pack 100 can protrude when the blister pack 100 is fitted to the back area 206. Typically the medication dispenser of the invention is designed to accept a blister pack containing eight blisters in two rows of four. The top plate 202 can have individual apertures for each blister 104 of the blister pack 100 or can, as shown, have a single aperture 208 shaped to receive the blister pack 100 and locate it securely within the top plate 202. After the blister pack 100 is fitted to the back area 206 of the top plate 202 with the blisters protruding through the aperture 208, the bottom plate 210 is applied to the lower surface of the blister pack and engaged with the top plate 202. Consequently, the blister pack is confined between the top plate 202 and the bottom plate 210 to form a relatively stiff card which permits the blister pack 100 to be conveniently handled and combined with other cards in a frame as is explained in more detail below. The bottom plate 210 is also provided with dispensing apertures 212 in register with the blisters of the blister pack in order to permit the unit dose to be expelled from the blister through the frangible bottom seal. The top plate 202 and the bottom plate 210 can be made of any suitable material such as plastic, metal, cardboard and the like. For ease of fabrication, economy and durability, it is preferred to make the top and bottom plates of plastic. In the preferred embodiment illustrated in FIGS. 2, 3 and 4, the bottom plate 210 is hinged to the top plate 202 by means of hinge 214, which can be a section of plastic made sufficiently thin that it easily flexes to permit the plates to be moved apart. However, it will be understood by those skilled in the art that the bottom plate 210 can be separate and be fastened to the top plate 202 by any conventional fastening means, e.g., snaps, clips, and the like. In the preferred embodiment of FIGS. 2, 3 and 4 the bottom plate 210 is latched to the top plate 202 by means of resilient hooks 216 which engage notches 218 at the end of the top plate 202 opposite the hinge 214. Retaining tabs 220 are provided on the edges of the top plate 202 for retaining the medication dispensing card within the card frame 300 as discussed more fully below. Such retaining tabs could also be provided on the bottom plate 210 instead of on the top plate 202.

In order to provide for labeling the medication dispensing card and to simultaneously provide the card with sufficient strength and stiffness for convenient handling, a bridge member 222 is attached to the face 204 of the top plate 202, spanning a portion of the face 204. The bridge member 222 comprises a label-receiving surface 226 and one or more bridge support members 224 which support the label receiving surface 226 at a sufficient distance above the face 204 of top plate 202 to avoid interference with the blisters 104 of the blister pack 100. The distance between the label receiving surface of the bridge and the face of the top plate will depend on the configuration of the blisters on the blister pack. If the blisters extend under the label receiving surface of the bridge it should be spaced from the top surface of the top plate far enough to avoid crushing the blisters or otherwise interfering with the installation of the blister pack.

If the blisters are of a smaller extent and do not have to extend under the bridge, the label receiving surface can be closer to the face of the top plate. In the illustrated embodiment a supporting rib 225 also supports the label receiving surface and helps to stiffen the bridge structure. The area of the label-receiving surface 226 is made smaller than the area of the face area 204 of the top plate 202 in order to provide for easy inspection of the blister pack 100.

The label-receiving surface 226 is typically planar for receiving a paper label 230 and is oriented generally parallel to the face area 204 of the top plate 202. However, it may be inclined or curved for better visibility or imparting greater strength to the bridge member if desired. The label-receiving surface 226 may be a plain smooth area suitable for receiving an adhesive label. However it is preferred, as illustrated, to provide tabs 228 which can retain a plain paper label 230 that is inserted under the tabs 228 and can be easily removed to provide for reuse of the medication dispenser card.

When the unit doses in the blister pack 100 are exhausted, or the medication is discontinued for other reasons, the medication dispensing card 200 can be unloaded by unlatching the bottom plate 210 and swinging it out of the way to allow removal of the spent blister pack. The medication dispenser card can then be reloaded with another blister pack and relabeled for another use.

Because it is frequently necessary to administer more than one medication at a time, it is convenient to incorporate more than one medication dispensing card into a frame as illustrated in FIGS. 1, 5, 6, and 7. Typically, the card frame 300 of the invention will incorporate four or six cards, although larger or smaller frames may be used as may be convenient. The illustrated embodiment of the frame of the invention is designed to accept four medication dispensing cards.

The card frame 300 of the invention comprises a base 302, side walls 306, an interior longitudinal wall 308 and interior transverse walls 310. The interior walls divide the frame 300 into individual compartments each adapted to receive a single medication dispensing card 200. If a larger frame is desired, additional card compartments can be provided by extending the base and providing additional interior walls. The base 302 may be a solid rectangular plate; however, in the illustrated preferred embodiment the base 302 is provided with apertures 304 that expose the apertures 212 in the bottom plate 210 of the medication dispensing card 200, and thereby permit the unit doses to be expelled from the blisters 104 without removing the medication dispensing cards 200 from the card frame 300. The medication dispensing cards 200 of the invention can be secured within the compartments of the card frame 300 by any conventional fastening method, e.g., clips or the like. In the illustrated preferred embodiment the side walls 306 and interior longitudinal wall 308 are provided with bosses 312 which interact with tabs 220 on the periphery of the top plate 202 or bottom plate 210 to secure the medication dispensing cards 200 within the frame 300. Because engaging the retaining tabs 220 under the bosses 312 requires only a short sliding motion, the medication dispensing card can be quickly inserted and released without sliding for a long distance along the base 302 of the frame 300, thereby avoiding interference between the torn flaps of the blister pack seals and the base 302 of the frame 300.

The card frame may also incorporate indicia on an exterior wall to provide relevant information, e.g., the patient's name and the time of administration. In the preferred embodiment illustrated, an information bar 313 is attached to a side wall 306 as shown or may be molded integrally with the side wall 306. A slot 314 is provided on the information bar 313 to accept a label with the patient's name, etc. The information bar 313 may also be provided with indicia 316, e.g., colored dots, that can be covered or exposed by moving sliding covers 318, to indicate various conditions, e.g., time to refill the medication dispensers.

The card frame may be made of any appropriate material. Preferably the card frame is made of plastic for ease in molding and fabrication.

In using the medication dispensing system of the invention for control and dispensing of medication, blister packs containing a course of medication, e.g., containing the medication to be administered at one time during the day for a period of a week, are prepared. A medication dispensing card is prepared by inserting the blister pack into a medication dispensing holder of the invention, latching the holder closed, and inserting a label containing the patient identification and drug dispensing information into the label area. A card frame is selected and all medications to be given to an individual patient at one time are inserted into the frame. The frame is then stored in a convenient location, e.g., on a medication cart where it is readily available to the nurse or other medical professional who dispenses the medication to the patient. Alternatively, if a long course of medication, or chronic medication is to be dispensed, several one-week medication dispensing cards can be combined in a single frame to provide the medication for a longer period of time, e.g., four weeks or approximately one month.

The invention having now been fully described, it should be understood that it may be embodied in other specific forms or variations without departing form its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

We claim:

1. A medication dispenser for containing a blister pack of unit doses comprising:

a top plate having a face area and a back area with at least one aperture for receiving the blister portion of a blister pack, a bottom plate adapted to revceive said blister pack and to engage said back area of said top plate so as to confine said blister pack between said top plate and said bottom plate, said bottom plate having at least one dispensing aperture a register with said blister of said blister pack, a bridge spanning at least a portion of said face area of said top plate, said bridge comprising, a label-receiving surface having an area less than the area of said face area of said top plate and being located between blisters of said blister pack, and support members extending between said label receiving surface and said face area of said top plate, said label-receiving surface being spaced above said face area of said top plate a distance sufficient to avoid interference with said blisters of said blister pack.

2. The medication dispenser of claim 1 wherein said aperture in said top plate is a single aperture shaped to confine said blister pack.

3. The medication dispenser of claim 1 wherein said top plate and said bottom plate are connected by a hinge.

4. The medication dispenser of claim 3 wherein said dispenser is molded from plastic and said hinge is a thin, flexible section of plastic integrally molded with said dispenser.

5. The medication dispenser of claim 1 wherein at least one of said top plate and said bottom plate are provided with retaining tabs extending laterally in the plane of said plate.

6. A medication dispenser for containing a blister pack of unit doses comprising:

a top plate having a face area and a back area with at least one aperture for receiving the blister portion of a blister pack;

a bottom plate adapted to receive said blister pack and to engage said back area of said top plate so as to confine said blister pack between said top plate and said bottom plate, said bottom plate having at least one dispensing aperture in register with said blister of said blister pack, a bridge spanning at least a portion of said face area of said top plate, said bridge comprising, a label-receiving surface having an area less than the area of said face area of said top plate, and support members extending between said label receiving surface and said face area of said top plate, said label-receiving surface being spaced above said face area of said top plate a distance sufficient to avoid interference with said blisters of said blister pack, and being provided with label-retaining tabs.

7. A medication dispenser for containing a blister pack of unit does comprising:

a top plate having a face area and a back area with at least one aperture for receiving the blister portion of a blister pack;

a bottom plate adapted to receive said blister pack and to engage said back area of said top plate so as to confine said blister pack between said top plate and said bottom plate, said bottom plate having at least one dispensing aperture in register with said blister of said blister pack;

a bridge spanning at least a portion of said face area of said top plate, said bridge comprising, a label-receiving surface having an area less than the area of said face area of said top plate, and support members extending between said label receiving surface and said face area of said top plate, said bridge support members include a longitudinal rib, said label-receiving surface being spaced above said face area of said top plate a distance sufficient to avoid interference with said blisters of said blister pack.

8. A medication dispenser-holding frame comprising a generally rectangular planar base, longitudinal side walls extending upward from two opposite sides of said rectangular base, bosses on the interior of said side walls for cooperation with retaining tabs on said medication dispenser to retain said dispenser within said frame, and at least one interior longitudinal wall parallel with said side walls and located centrally therebetween on said base, said interior longitudinal wall being provided with bosses for cooperation with retaining tabs on said medication dispenser to retain said dispenser within said frame.

9. In combination, a frame for holding a medication dispenser and a medication dispenser held in said frame, said medication dispenser comprising a top plate having a face area and a back area and at least one aperture for receiving a blister of a blister pack, a bottom plate adapted to engage said back area of said top plate thereby confining said blister pack between said top plate and said bottom plate, said bottom plate having at least one dispensing aperture in register with said blister of said blister pack, at least one of said top plate and said bottom plate having retaining tabs extending therefrom in the plane of said top plate or said bottom plate, a bridge spanning at least a portion of said face area of said top plate, said bridge comprising, a label-receiving surface having an area less than the area of said face area of said top plate, and support members extending between said label receiving surface and said face area of said top plate, said label-receiving surface being spaced above said face area of said top plate a distance sufficient to avoid interference with said blisters of said blister pack, said medication dispenser being held within a frame comprising a generally rectangular planar base, longitudinal side walls extending upward from two opposite sides of said rectangular base, bosses on the interior of said side walls for cooperation with said retaining tabs on said medication dispenser to retain said dispenser within said frame.

10. The combination of claim 9 wherein said base is provided with apertures for dispensing unit doses from said medication dispenser held in said frame.

* * * * *